US008471647B2

(12) United States Patent
Tahara et al.

(10) Patent No.: US 8,471,647 B2
(45) Date of Patent: Jun. 25, 2013

(54) POWER DIVIDER

(75) Inventors: Yukihiro Tahara, Tokyo (JP); Takeshi Yuasa, Tokyo (JP); Naofumi Yoneda, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 379 days.

(21) Appl. No.: 12/937,109

(22) PCT Filed: Apr. 11, 2008

(86) PCT No.: PCT/JP2008/057177
§ 371 (c)(1),
(2), (4) Date: Oct. 8, 2010

(87) PCT Pub. No.: WO2009/125492
PCT Pub. Date: Oct. 15, 2009

(65) Prior Publication Data

US 2011/0032049 A1 Feb. 10, 2011

(51) Int. Cl.
*H01P 3/08* (2006.01)
*H01P 5/12* (2006.01)

(52) U.S. Cl.
USPC ..... 333/128; 333/125; 333/127

(58) Field of Classification Search
USPC ..... 333/109, 115–117, 121, 123–125, 333/127, 128
See application file for complete search history.

(56) References Cited

U.S. PATENT DOCUMENTS 4,673,958 A * 6/1987 Bayraktaroglu ..... 331/107 R
4,725,792 A * 2/1988 Lampe, Jr. ..... 333/26
4,777,718 A * 10/1988 Henderson et al. ..... 29/620
4,901,042 A 2/1990 Terakawa et al.

(Continued)

FOREIGN PATENT DOCUMENTS

DE 38 10 674 A1 10/1988
JP 63-246002 10/1988

(Continued)

OTHER PUBLICATIONS

M.C. Scardelletti et al.; "Miniaturized Wilkinson Power Dividers Utilizing Capacitive Loading"; IEEE Microwave and Wireless Components Letters, vol. 12, No. 1, Jan. 2002, pp. 6-8.*

(Continued)

*Primary Examiner* — Barbara Summons
(74) *Attorney, Agent, or Firm* — Oblon, Spivak, McClelland, Maier & Neustadt, L.L.P.

(57) ABSTRACT

In cases where a power divider is constructed by using a multilayer substrate, a power divider is obtained which is smaller in size and has a good reflection property. The power divider according to the present invention is provided with a multilayer dielectric substrate (1), strip conductor patterns (2*a* through 2*c*) formed on one surface of the multilayer dielectric substrate (1), and a ground conductor pattern (3) formed on the other surface of the multilayer dielectric substrate (1), wherein a transmission line is composed of the dielectric substrate (1), the strip conductor patterns (2*a* through 2*c*) and the ground conductor pattern (3), and the transmission line has its one end branched to form a plurality of branch lines (12*a*, 12*b*), with an isolation resistance (4) being formed between the branch lines. A first capacitance forming part comprising a first pillar conductor (6*a*) and a first capacitance forming conductor pattern (5*a*), both formed in an interior of the dielectric substrate (1), is formed at a branch point (13) of said transmission line.

4 Claims, 3 Drawing Sheets

U.S. PATENT DOCUMENTS

| | | | | |
|---|---|---|---|---|
| 5,079,527 | A * | 1/1992 | Goldfarb | 333/127 |
| 5,650,756 | A | 7/1997 | Hayashi | |
| 6,437,806 | B1 | 8/2002 | Iwasa | |
| 6,489,859 | B1 | 12/2002 | Tahara et al. | |
| 6,570,466 | B1 * | 5/2003 | Bahl | 333/128 |
| 6,967,544 | B2 * | 11/2005 | Ji | 333/136 |
| 7,005,721 | B2 * | 2/2006 | Nishijima | 257/531 |
| 7,285,813 | B2 * | 10/2007 | Park | 257/296 |
| 7,920,035 | B2 * | 4/2011 | Panaghiston | 333/128 |
| 7,982,555 | B2 * | 7/2011 | Rofougaran | 333/128 |
| 2002/0175939 | A1 | 11/2002 | Iwasa | |
| 2004/0263283 | A1 | 12/2004 | Ji | |

FOREIGN PATENT DOCUMENTS

| | | | |
|---|---|---|---|
| JP | 5-37212 | | 2/1993 |
| JP | 6-53414 | | 2/1994 |
| JP | 6-291501 | | 10/1994 |
| JP | 11-330813 | | 11/1999 |
| JP | 2002-344276 | | 11/2002 |
| WO | WO 2007/063344 | * | 6/2007 |

OTHER PUBLICATIONS

Staudinger and Scardelletti; "Correspondence Comments on 'Miniaturized Wilkinson Power Dividers Utilizing Capacitive Loading' and Authors Reply"; IEEE Microwave and Wireless Components Letters, vol. 12, No. 4, Apr. 2002, p. 145.*

B. Piernas et al.; "Enhanced Miniaturized Wilkinson Power Divider"; 2003 IEEE MTT-S International Microwave Syposium Digest, vol. 2, pp. 1255-1258, Jun. 8-13, 2003.*

Miyauchi, Y., "Tsushin'yo Microwave Kairo," Denshi Tsushin Gakkai, pp. 63-64, (Oct. 20, 1981).

International Search Report issued Jun. 3, 2008 in PCT/JP08/057177 filed Apr. 11, 2008.

Japanese Office Action issued Aug. 21, 2012, in Japan Patent Application No. 2010-507099 (with English translation).

Extended European Search Report issued Dec. 7, 2011, in Patent Application No. 08740274.9.

Kari Kautio, et al., "20 GHz Wilkinson Power Dividers in LTCC Technology", Module Packaging, XP 2378136, 2004, pp. 38-39, Jan. 1, 2004.

* cited by examiner

POWER DIVIDER

TECHNICAL FIELD

The present invention relates mainly to a power divider which distributes or synthesizes high frequency signals of a microwave band and a millimeter wave band.

BACKGROUND ART

A power divider is widely used in order to distribute (divide) and/or synthesize a high frequency signal. As the construction of such a power divider represented by a plane circuit such as microstrip lines, there has been reported one in which a strip conductor is branched into two branch lines with a stub being formed at a branching portion (for example, see a first patent document).

The power divider described in this first patent document has an isolation circuit composed of an isolation resistance and a connecting line arranged between the two branch lines, and further has the stub with a open tip formed in the branching portion, whereby the parasitic reactance of the isolation circuit is offset or canceled by the stub, thus achieving a power divider of a good reflection property as seen from an input terminal.

First Patent Document: Japanese patent application laid-open No. H11-330813

DISCLOSURE OF THE INVENTION

Problems to be Solved by the Invention

However, in the conventional power divider described in the first patent document, there has been a problem that the occupying area of the power divider becomes large due to the formation of the stub in the same plane as the strip conductor which constitutes the power divider. In addition, there has also been another problem that in the case of an arrangement in which the branch lines and the stub are arranged in close proximity with each other, the reflection property is deteriorated.

The present invention has been made so as to solve the problems as referred to above, and has for its object to obtain a power divider which is smaller in size and has a good reflection property in cases where the power divider is constructed by the use of a multilayer substrate.

Means for Solving the Problems

A power divider according to the present invention is provided with a dielectric substrate, strip conductor patterns formed on one surface of said dielectric substrate, and a ground conductor pattern formed on the other surface of said dielectric substrate, wherein a transmission line is composed of said dielectric substrate, said strip conductor patterns and said ground conductor pattern, and said transmission line has its one end branched to form a plurality of branch lines, with an isolation resistance being formed between said branch lines, said power divider being characterized in that a first capacitance forming part comprising a first pillar conductor and a first capacitance forming conductor pattern, both formed in an interior of said dielectric substrate, is formed at a branch point of said transmission line.

Effect of the Invention

According to the present invention, even in cases where the magnitude or size of the isolation resistance can not be ignored with respect to a wavelength in a millimeter wave band or the like, impedance matching can be made by means of a parallel capacitance formed at the branch point, the branch lines, and a susceptance which arises from the stub due to the isolation resistance, as a result of which there is provided an effect that a power divider having a good reflection property can be achieved. In addition, because the parallel capacitance is formed by the first pillar conductor and the first capacitance forming conductor pattern at the branch point, the property deterioration due to an unnecessary combination with the branch lines is smaller as compared with a conventional construction in which a matching stub is formed in a branch point, thus providing an effect that it is easy to achieve a good property.

BEST MODE FOR CARRYING OUT THE INVENTION

First Embodiment

Figure 1:
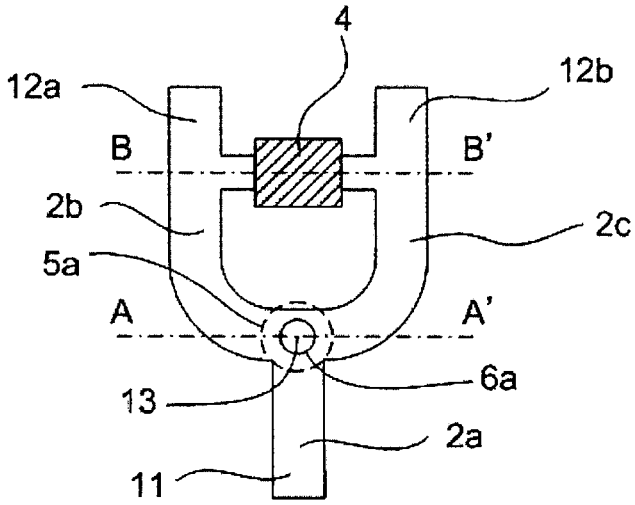
FIG. 1 is a perspective view from top, showing the construction of a power divider in a first embodiment of the present invention.

FIG. 1 is a perspective view from top, showing the construction of a power divider according to a first embodiment of the present invention. Also, FIG. 2 is a cross sectional view along line A-A' in FIG. 1, and FIG. 3 is a cross sectional view along line B-B' in FIG. 1.

Figure 2:
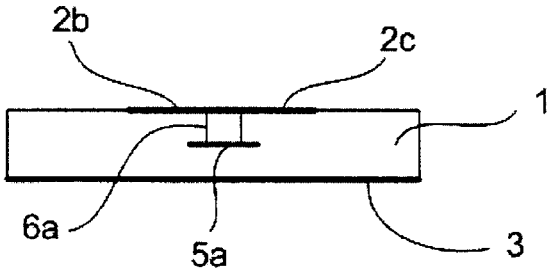
FIG. 2 is a cross sectional view along line A-A' in FIG. 1.
Figure 3:
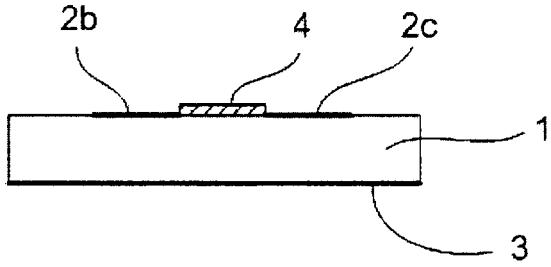
FIG. 3 is a cross sectional view along line B-B' in FIG. 1.

As shown in FIG. 1 through FIG. 3, the power divider according to the first embodiment is provided with a multilayer dielectric substrate 1, strip conductor patterns 2*a* through 2*c* formed on a front surface of the multilayer dielectric substrate 1, and a ground conductor pattern 3 formed on a rear surface of the multilayer dielectric substrate 1, wherein an input line 11 and branch lines 12*a*, 12*b*, acting as a transmission line, are formed of the multilayer dielectric substrate 1, the strip conductor patterns 2*a*, 2*b*, 2*c* and the ground conductor pattern 3, wherein the input line 11 and the branch lines 12*a*, 12*b* are connected with each other at a branch point 13. Here, note that all the characteristic impedances of the input line 11 and the branch lines 12*a*, 12*b* become equal to each other.

In addition, a resistance film 4 acting as an isolation resistance is arranged between the branch lines 12*a* and 12*b* on a front or surface layer of the multilayer dielectric substrate 1. The resistance film 4 has its opposite ends connected to the strip conductor patterns 2*b*, 2*c*, respectively, and the length from the branch point 13 in the branch lines 12*a*, 12*b* to each connection point of the resistance film 4 becomes longer than ⅛ of a propagation wavelength in the branch lines 12*a*, 12*b*, and shorter than ¼ thereof.

Further, a first capacitance forming conductor pattern 5*a* is arranged in an internal layer of the multilayer dielectric substrate 1 under the branch point 13, and a capacitance forming conductor via 6*a* acting as a first pillar conductor is arranged in the multilayer dielectric substrate 1 at the branch point 13 in such a manner that the strip conductor patterns 2*a*, 2*b*, 2*c* and the capacitance forming conductor pattern 5*a* are connected with each other. A first capacitance forming part is formed of the capacitance forming conductor pattern 5*a* and the capacitance forming conductor via 6*a*, and a parallel capacitance is formed at the branch point 13 by arranging the ground conductor pattern 3 and the capacitance forming conductor pattern 5*a* in opposition to each other.

Next, reference will be made to the operation of the power divider according to this first embodiment. A high frequency signal inputted to the input line 11 is propagated by being divided into the branch lines 12*a*, 12*b* at the branch point 13. In this operational mode, the opposite ends of the resistance film 4 become the same electric potential due to the symmetry of the circuit, so a current does not flow in the resistance film 4, ideally. However, in a millimeter wave band, the area of the resistance film 4 becomes so large as not to be ignored with respect to the wavelength of a millimeter wave or signal, and hence the resistance film 4 operates as a tip open stub with respect to the branch lines 12*a*, 12*b*. Accordingly, in this power divider, impedance matching between an input and an output thereof is made by the use of the tip open stub formed of the resistance film 4, the branch lines 12*a*, 12*b* and a parallel capacitance formed of the capacitance forming conductor pattern 5*a*.

Figure 4:
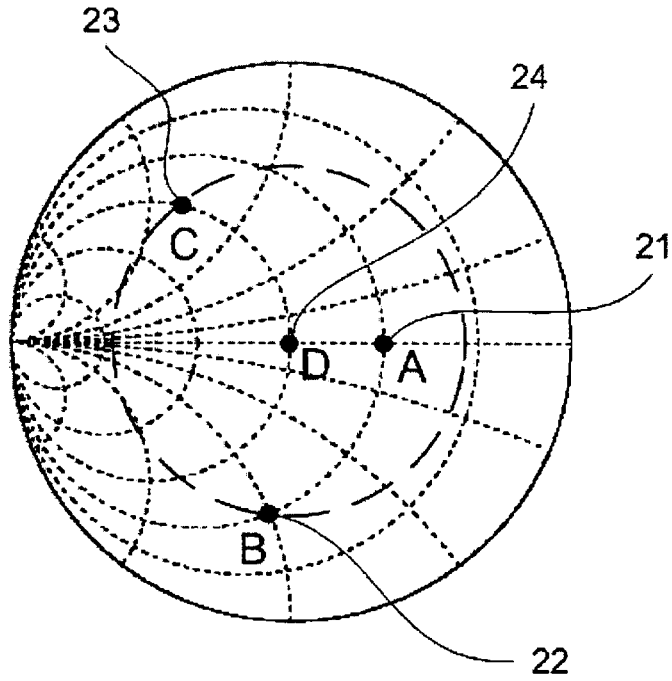
FIG. 4 is a view showing an admittance chart, as seen from a branch line side in the power divider according to the first embodiment of the present invention.

An admittance chart in this power divider as seen from a branch line side is shown in FIG. 4. An admittance as seen from the branch lines at the branch point 13 to an input line side is located at an A point 21 in FIG. 4. The admittance is moved up to a B point 22 along a constant conductance circle due to the parallel capacitance formed by the capacitance forming conductor pattern 5*a* formed at the branch point 13. Accordingly, when a reference point is moved to each of the connection points of the branch lines 12*a*, 12*b* and the resistance film 4 along the branch lines 12*a*, 12*b*, the admittance becomes a C point 23. Moreover, the admittance reaches a D point 24 in the center of the admittance chart due to the susceptance of the tip open stub formed by the resistance film 4.

That is, it is seen that the impedance matching between the input and the output can be achieved by means of the parallel capacitance that is formed by the capacitance forming conductor pattern 5*a* formed at the branch point 13, the branch lines 12*a*, 12*b*, and the susceptance due to the tip open stub formed by the resistance film 4. Here, it will be understood that because the angle of rotation in phase from the B point 22 to the C point 23 is from 90 degrees to 180 degrees, the length from the branch point 13 of the branch lines 12*a*, 12*b* to each of the connection points of the resistance film 4 is from ⅛ to ¼ of the wavelength.

On the other hand, the high frequency signal inputted to the branch line 12*a* or 12*b* is absorbed by the resistance film 4, so the isolation between the branch lines is obtained.

As described above, according to the first embodiment of the present invention, even in cases where the magnitude or size of the isolation resistance can not be ignored with respect to a wavelength in a millimeter wave band or the like, impedance matching is made by means of the parallel capacitance formed at the branch point 13, the branch lines 12*a*, 12*b*, and the susceptance due to the stub formed by the isolation film 4 which acts as an isolation resistance, as a result of which there is provided an effect that a power divider having a good reflection property can be achieved. In addition, the parallel capacitance is formed at the branch point 13 by means of the conductor via 6*a* and the capacitance forming conductor pattern 5*a*, so the property deterioration due to an unnecessary combination with the branch lines is smaller as compared with a conventional construction in which a matching stub is formed at a branch point, thus providing an effect that it is easy to achieve a good property.

In addition, the length from the branch point 13 of the branch lines 12*a*, 12*b* to each of the connection points of the resistance film 4 acting as an isolation resistance becomes from ⅛ to ¼ of the wavelength, there is an effect that a power divider can be obtained which is smaller as compared with a conventional power divider using an impedance transformer of a ¼ wavelength. Moreover, because the impedance matching is achieved by means of the resistance film 4 and the parallel capacitance, the characteristic impedance of the branch lines 12*a*, 12*b* need not be higher than that of the input line 11, and hence there is also another effect that a high impedance line is unnecessary and it is easy to construct a power divider even in cases where a thin dielectric substrate is used.

Here, note that in the example shown in FIG. 1 through FIG. 3 in this first embodiment, the input line 11 and the branch lines 12*a*, 12*b* are formed to have the same line width and the same characteristic impedance, but they may also be lines with mutually different characteristic impedances, respectively. In particular, in cases where the characteristic impedances of the branch lines 12*a*, 12*b* are different from each other, an input signal is distributed or divided by a power ratio corresponding to the difference between the characteristic impedances.

Further, although in the example shown in FIG. 1 through FIG. 3 in this embodiment 1, the shape of the capacitance forming conductor pattern 5*a* is shown to be circular, it is not limited to this, but any arbitrary shape such as a polygonal shape, an elliptical shape, etc., may be used.

Second Embodiment

Figure 5:
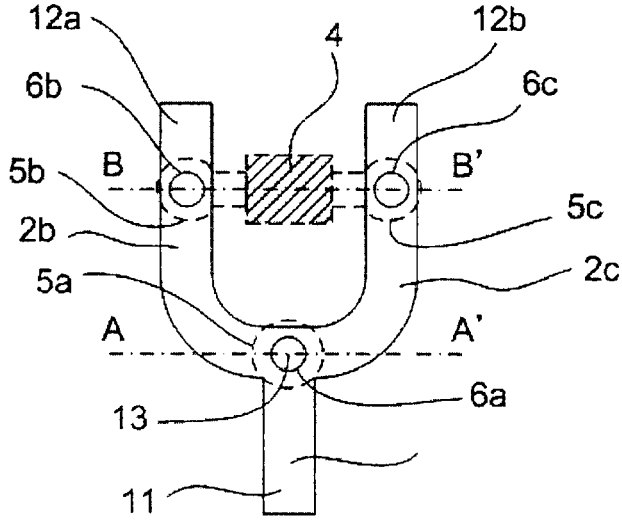
FIG. 5 is a perspective view from top, showing the construction of a power divider in a second embodiment of the present invention.

FIG. 5 is a perspective view from top, showing the construction of a power divider according to a second embodiment of the present invention. In addition, FIG. 6 is a cross sectional view along line A-A' in FIG. 5, and FIG. 7 is a cross sectional view along line B-B' in FIG. 5.

Figure 6:
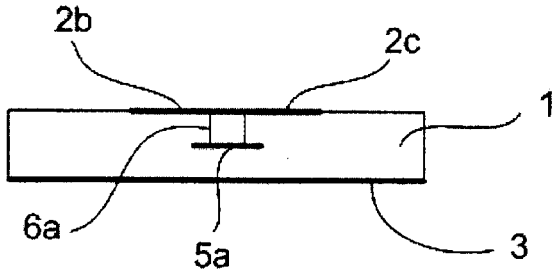
FIG. 6 is a cross sectional view along line A-A' in FIG. 5.
Figure 7:
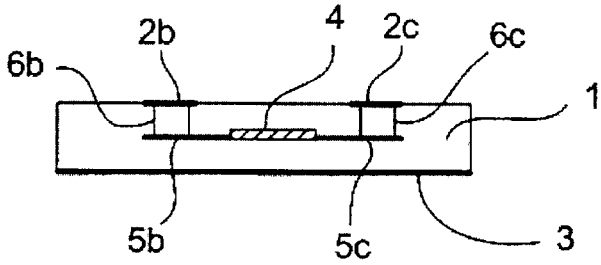
FIG. 7 is a cross sectional view along line B-B' in FIG. 5.

In FIG. 5 through FIG. 7, the same parts as those of the above-mentioned first embodiment shown in FIG. 1 through FIG. 3 are denoted by the same reference numerals and characters, and the explanation thereof is omitted. As new reference numerals and characters, 5*b* and 5*c* denote second capacitance forming conductor patterns formed in an internal layer of a multilayer dielectric substrate 1 under strip conductor patterns 2*b*, 2*c*, respectively, and 6*b* and 6*c* denote capacitance forming conductor vias acting as second pillar conductors, respectively, which are arranged in the multilayer dielectric substrate 1 so as to connect the strip conductor patterns 2*b*, 2*c* and the capacitance forming conductor patterns 5*b*, 5*c* with each other, respectively.

That is, in the second embodiment shown in FIG. 5 through FIG. 7, second capacitance forming parts comprising the capacitance forming conductor vias 6*b*, 6*c* and the capacitance forming conductor patterns 5*b*, 5*c*, respectively, all of which are formed in the interior of the dielectric substrate 1, are arranged at connection points of branch lines 12*a*, 12*b* and a resistance film 4, respectively, and parallel capacitances are formed by arranging a ground conductor pattern 3 and the capacitance forming conductor patterns 5*b*, 5*c* in opposition to each other, respectively. The resistance film 4 is arranged in an internal layer of the multilayer dielectric substrate 1, and has its opposite ends connected to the capacitance forming conductor patterns 5*b*, 5*c*, respectively, and in addition, the resistance film 4 is also connected to the branch lines 12*a*, 12*b* through the capacitance forming conductor vias 6*b*, 6*c*, respectively.

Next, reference will be made to the operation of the power divider according to this second embodiment. A high frequency signal inputted to an input line 11 is propagated by being divided into the branch lines 12*a*, 12*b* at a branch point 13. In this operational mode, the opposite ends of the resistance film 4 become the same electric potential due to the symmetry of the circuit, so a current does not flow in the resistance film 4, ideally. However, in a millimeter wave band, the area of the resistance film 4 becomes so large as not to be ignored with respect to the wavelength of a millimeter wave or signal, and hence the resistance film 4 operates as a tip open stub with respect to the branch lines 12*a*, 12*b*.

Further, in FIG. 5, the resistance film 4 is connected to the strip conductor patterns 2*b*, 2*c* through the capacitance forming conductor patterns 5*b*, 5*c*, respectively, so in addition to a susceptance due to the resistance film 4 operating as a tip open stub, susceptances are also generated due to the parallel capacitances formed between the capacitance forming conductor patterns 5*b*, 5*c* and the ground conductor pattern 3, respectively. Accordingly, larger susceptances will be obtained in the connection points between the branch lines 12*b*, 12*c* and the resistance film 4, respectively, and impedance matching can be made even in cases where the difference in the impedance between an input and an output is large.

As described above, according to the second embodiment of the present invention, even in cases where the magnitude or size of the isolation resistance can not be ignored with respect to a wavelength in a millimeter wave band or the like, impedance matching is made by a parallel capacitance formed at the branch point 13, the branch lines 12*a*, 12*b*, a susceptance due to the stub formed by the resistance film 4 acting as an isolation resistance, and the parallel capacitances formed at the connection points of the branch lines 12*a*, 12*b* and the resistance film 4 acting as an isolation resistance. As a result, there is provided an effect that a power divider having a good reflection property can be achieved. In addition, the parallel capacitances are formed not only at the branch point 13 but also at the connection points of the branch lines 12*a*, 12*b* and the resistance film 4 acting as an isolation resistance, so there is an effect that it is easy to achieve impedance matching even in cases where the difference in the impedance between the input and the output is large.

Moreover, the value of a susceptance used for impedance matching can be made larger by means of the parallel capacitances which are formed at the connection points of the branch lines 12*a*, 12*b* and the resistance film 4 acting as an isolation resistance, so there is also an effect that in the branch lines 12*a*, 12*b*, the lengths from the branch point 13 to their connection points with the resistance film 4 acting as an isolation resistance can be made shorter.

Further, in this second embodiment, the resistance film 4 is formed in the internal layer of the multilayer dielectric substrate 1, as shown in FIG. 7, so there is also an effect that the reliability of the resistance film 4 is improved as compared with the case in which the resistance film 4 is formed on a surface layer.

The invention claimed is:

1. A power divider comprising:

a dielectric substrate;

strip conductor patterns formed on one surface of said dielectric substrate; and a ground conductor pattern formed on an other surface of said dielectric substrate, wherein a transmission line is composed of said dielectric substrate, said strip conductor patterns and said ground conductor pattern, and said transmission line has one end branched to form a plurality of branch lines, with an isolation resistance being formed between said branch lines, wherein a first capacitance forming part comprising a first pillar conductor and a first capacitance forming conductor pattern, both formed in an interior of said dielectric substrate, is formed at a branch point of said transmission line, and said transmission line comprises an input line and said plurality of branch lines which are branched from said input line at said branch point, and characteristic impedances of said input line and said branch lines are equal to each other.

2. The power divider as set forth in claim 1, wherein second capacitance forming parts each comprises a second pillar conductor and a second capacitance forming conductor pattern, both formed in the interior of said dielectric substrate, and formed at connection points of said branch lines and said isolation resistance, respectively.

3. The power divider as set forth in claim 2, wherein said isolation resistance is formed in the interior of said dielectric substrate, and has its opposite ends connected to said branch lines through said second pillar conductors and said second capacitance forming conductor patterns, respectively.

4. The power divider as set forth in claim 1, wherein said isolation resistance is formed by a resistance film.

* * * * *